United States Patent [19]

Lukasiewicz

[11] 4,067,699

[45] Jan. 10, 1978

[54] FUEL COMPOSITION

[75] Inventor: Ronald J. Lukasiewicz, Irvine, Calif.

[73] Assignee: Union Oil Company of California, Los Angeles, Calif.

[21] Appl. No.: 751,384

[22] Filed: Dec. 17, 1976

[51] Int. Cl.[2] ..... C10L 1/18

[52] U.S. Cl. ..... 44/66; 44/68; 252/386

[58] Field of Search ..... 44/66, 68; 252/386; 260/429 CY

[56] References Cited

U.S. PATENT DOCUMENTS

| | | | |
|---|---|---|---|
| 2,818,416 | 12/1957 | Brown et al. | 44/68 |
| 2,818,417 | 12/1957 | Brown et al. | 44/68 |
| 2,839,552 | 6/1958 | Shapiro et al. | 44/68 |
| 3,146,203 | 8/1964 | Frew, Jr. | 44/68 |
| 3,169,116 | 2/1965 | Baseman et al. | 44/66 |

*Primary Examiner*—Daniel E. Wyman
*Assistant Examiner*—Mrs. Y. Harris-Smith
*Attorney, Agent, or Firm*—Gregory F. Wirzbicki; Lannas S. Henderson; Richard C. Hartman

[57] ABSTRACT

Gasoline compositions containing methylcyclopentadienylmanganesetricarbonyl (hereinafter MCMT) are stabilized against oxidation by the addition of 2-ethylhexanoic acid.

4 Claims, No Drawings

FUEL COMPOSITION

BACKGROUND OF THE INVENTION

This invention relates to gasoline compositions containing additives for improving the octane rating of said gasoline, and more specifically to gasoline compositions containing stabilizers for said additives.

MCMT is presently being used as a component of gasoline fuels to improve the octane number thereof. However, in the proportions in which it is present in the gasoline fuels, usually between about 0.05 and 0.20 gm/gal (as manganese), MCMT is unstable. In the presence of sunlight, or other source of ultra-violet radiation, MCMT rapidly oxidizes to components that precipitate, with the rate of oxidation being dependent upon the concentration of dissolved oxygen in the gasoline. Thus, when gasoline containing 0.1 gm/gal MCMT (as manganese) is exposed to sunlight, within about 2–3 hours nearly complete oxidation of MCMT occurs, and a precipitate of oxidation products is formed. Similar oxidation takes place in the absence of sunlight, but at a somewhat slower rate. Cnsequently, gasoline compositions containing MCMT which are placed in storage for even few weeks suffer a significant decrease in octane rating and form a solid precipitate capable of clogging valves, transfer lines, etc.

SUMMARY OF THE INVENTION

In accordance with this invention 2-ethylhexanoic acid has been found to be effective as an anti-oxidant for gasoline fuels containing MCMT. The addition of 2-ethylhexanoic acid to such fuels prevents oxidation of the MCMT even in the presence of sunlight and oxygen. The invention thus consists in gasoline fuels containing MCMT and 2-ethylhexanoic acid in an amount sufficient to inhibit the oxidation of the MCMT. The addition of 2-ethylhexanoic acid to gasoline fuels also aids in preventing the MCMT from being evaporated in vessels open to the atmosphere.

DETAILED DESCRIPTION OF THE INVENTION

Gasoline fuels containing MCMT as an octane rating additive usually contain said MCMT in an amount sufficient to provide between about 0.05 and about 0.2, preferably between about 0.1 and about 0.15 grams per gallon of manganese. The amount of 2-ethylhexanoic acid required to stabilize such fuels against oxidation will depend upon the length of time the fuel will be stored prior to use and the condition of storage. Ordinarily, such amount will be at least 0.05 volume percent, and preferably between about 0.5 and 2.0 volume percent. If the fuel is to be stored over an extended period of time, or under unusually adverse conditions, the 2-ethylhexanoic acid content may be increased to as much as 3 volume percent.

2Ethylhexanoic acid is highly soluble in light hydrocarbons; consequently, preparation of the composition of this invention is simply a matter of dissolving the additive in the gasoline, either before, after, or concurrently with addition of the MCMT, employing conventional fuel blending equipment.

The following Example demonstrates the effectiveness of 2-ethylhexanoic acid for stabilizing MCMT.

EXAMPLE

One fuel composition containing gasoline and MCMT and four fuel compositions containing gasoline, MCMT, and 2-ethylhexanoic acid were exposed to sunlight during the daylight hours of four consecutive days. Each of the compositions contained 0.1 gm MCMT (as manganese) per gallon of the liquid compositions. The 2-ethylhexanoic acid was present in proportions ranging as follows: 0, 0.01, 0.1, 0.5, and 1.0 volume percent of the liquid compositions.

The results were as follows. After 3 hours of sunlight exposure, the composition containing no 2-ethylhexanoic acid developed a precipitate, thereby indicating that the MCMT had been oxidized to undesirable products. After one day (about 10 hours of sunlight exposure) the composition containing 0.01 volume precent of 2-ethylhexanoic acid had turned dark brown, showing an initial stage of MCMT oxidation; the other compositions containing 2-ethylhexanoic acid were only slightly brown, with the intensity of the brown color decreasing with increased proportion of the 2-ethylhexanoic acid in the respective compositions. After four days (about 40 hours of sunlight exposure) the compositions containing 0.01 and 0.1 volume percent of 2-ethylhexanoic acid had developed a precipitate while the compositions containing 0.5 and 1.0 volume precent of 2-ethylhexanoic acid were of medium brown color but contained no precipitate.

The data in this Example show that the addition of sufficient 2-ethylhexanoic acid to gasoline so as to produce a composition containing at least 0.5 volume percent of 2-ethylhexanoic acid insures that the MCMT in said composition remains unoxidized during long exposure to direct sunlight.

Although the invention has been described in conjunction with a specific example thereof, it is evident that many alterations, modifications, and variations will be apparent to those skilled in the art in light of the foregoing description. Accordingly, it is intended to embrace all such alternatives, modifications, and variations that fall within the spirit and scope of the appended claims.

I claim:

1. A gasoline composition suitable for use as a fuel for internal combustion engines comprising a major proportion of gasoline, methylcyclopentadienylmanganesetricarbonyl in a proportion at least sufficient to increase the octane rating of the gasoline, and 2-ethylhexanoic acid in a proportion at least sufficient to inhibit oxidation of said methylcyclopentadienylmanganesetricarbonyl.

2. A composition as defined in claim 1 wherein said composition contains said methylcyclopentadienylmanganesetricarbonyl in a proportion between about 0.05 and 0.20 gm/gal (as manganese) and said 2-ethylhexanoic acid in a proportion of at least about 0.05 volume percent.

3. A composition as defined in claim 2 wherein said 2-ethylhexanoic acid is present in a proportion between about 0.1 and 3.0 volume percent.

4. A composition as defined in claim 3 wherein said 2-ethylhexanoic acid is present in a proportion between about 0.5 and 2.0 volume percent.

* * * * *